United States Patent [19]

Ostrowski

[11] Patent Number: 4,991,978

[45] Date of Patent: Feb. 12, 1991

[54] TOWEL BAG COMBINATION APPARATUS

[76] Inventor: Michael J. Ostrowski, 91 Old Toll Rd., West Barnstable, Mass. 02668

[21] Appl. No.: 465,809

[22] Filed: Jan. 16, 1990

Related U.S. Application Data

[63] Continuation-in-part of Ser. No. 437,216, Nov. 16, 1989, abandoned.

[51] Int. Cl.[5] ..... B65D 30/10; B65D 33/02; B65D 33/12

[52] U.S. Cl. ..... 383/4; 383/6; 383/13; 383/76

[58] Field of Search ..... 383/4, 76, 6, 13; 190/1; 428/66

[56] References Cited

U.S. PATENT DOCUMENTS

| | | | |
|---|---|---|---|
| D. 128,122 | 7/1941 | Lewis . | |
| D. 293,060 | 12/1987 | Botbol . | |
| 791,677 | 6/1905 | Dowling | 383/4 |
| 977,129 | 11/1910 | Reynolds | 383/4 |
| 1,688,288 | 10/1928 | Rogers | 383/4 |
| 2,344,010 | 3/1944 | Walsh | 383/4 |
| 2,626,648 | 1/1953 | Anderson | 383/4 |
| 2,803,845 | 8/1957 | Bradford . | |
| 3,346,155 | 10/1967 | Oechsle | 383/13 |
| 3,967,668 | 7/1976 | Franco | 383/4 |
| 4,337,812 | 7/1982 | Trinkner | 383/4 |
| 4,794,029 | 12/1988 | Tennant et al. | 383/4 |

*Primary Examiner*—Stephen P. Garbe
*Attorney, Agent, or Firm*—Richard P. Crowley

[57] ABSTRACT

A towel bag combination apparatus which in the open position is used for towel or beach-type purposes and in the closed position is an enclosed bag with a carrying strap. The towel bag combination apparatus comprises a circular fabric towel element with a reinforced peripheral web with draw holes in the web and a ring near the web, and with the bottom surface having a reinforced section and a loop secured thereto. The towel-bag apparatus also includes an elastic draw cord having a one and an other end and passing through the holes in the web and having the one and other end include a spring loaded clip. The draw cord permits the circular towel to move an open position for towel use and a closed bag use, the draw cord passing through the loop and with the spring loaded clip adapted to engage the ring so as to form a carrying strap for the towel bag combination apparatus in the closed position.

7 Claims, 3 Drawing Sheets

TOWEL BAG COMBINATION APPARATUS

REFERENCE TO PRIOR APPLICATION

This application is a continuation-in-part application of U.S. S.N. 07/437,216, filed Nov. 16, 1989, now abandoned.

BACKGROUND OF THE INVENTION

It is often desirable for use at the beach to have a towel fabric for drying purposes and to lay on and also to have an easily formed container or bag to carry items such as those for example employed at the beach. Therefore a combination towel-bag, which is simply constructed and easily adapted to move from between a towel-beach use and bag-containing use is desirable and further to have the bag include an easily adaptable carrying strap. Towel fabrics come in various sizes and shapes, and circular towel fabrics for example are shown in U.S. Pat. No. 2,803,845, issued Aug. 27, 1957 and U.S. Design Patent No. 293,060, issued Dec. 8, 1987. In addition, beach kits formed or having a particularly formed container are illustrated in U.S. Design Patent No. 128,122, issued July 8, 1941.

It is therefore desirable to provide for a towel-bag apparatus of simple design and construction and which is easily adapted to move between a towel or beach use in an open position and a tote bag in a closed position and which provides for a bag having an integrally formed shoulder or carrying strap therein.

SUMMARY OF THE INVENTION

The invention relates to a towel-bag combination apparatus, which in the open position provides a towel for drying and beach purposes and in the closed position provides for an enclosed bag with a carrying strap.

The invention is directed to a towel-bag apparatus which is adapted to move easily between an open position wherein a generally circular fabric towel element provides a towel for drying purposes or to be laid on the beach for sunning purposes and to a closed or partially closed position with the employment of a draw cord on the generally circular towel element to provide an enclosed bag, and further with the draw cord also providing a carrying strap for the bag. In particular, the towel bag apparatus of the invention employs the generally circular fabric towel element, such as a terrycloth, having a reinforced peripheral web and a plurality of draw holes, such as of metal or plastic grommets, in the reinforced web. The circular towel element has a top surface and a bottom surface with the bottom surface having a generally centrally reinforced section which may be of another type cloth or a canvas or vinyl plastic section, but generally of a different material to give more color and support to the central portion of the circular towel element. The reinforced section may be of varying size, such as round, square or triangular, and also includes a loop or ring centrally disposed therein to provide a means to hook a spring-loaded clip therein or to pass through the draw cord to form a carrying strap for the bag. Also the bottom surface has, near the reinforced web, a drawstring loop gathering and a ring to attach a hook from a spring-loaded clip for carrying purposes.

The towel-bag apparatus also includes a draw cord means, such as a string, or more typically an elastic-type cord, having a one and an other end and passing through the holes in the reinforced web typically in alternating fashion so as to permit the circular towel element to move between an open position for towel-beach use with the draw cord extended and in a relaxed position and a closed position wherein the reinforced web by means of the drawn draw cord is drawn inwardly to form a bag for use to place articles. The draw cord has a one and an other end which ends are generally secured together and includes a spring-loaded hook or clip at the one and other end so as to permit said clip in the closed position to engage either the loop either in the center of the reinforced center or alternatively, a ring secured near or adjacent the reinforced web so that the draw cord can form a carrying strap for a user when the towel bag is in the closed bag carrying position. The draw cord can be used as a shoulder or hand strap merely by securing the spring-loaded clip at the end of the draw cord to either the loop or the ring or the draw cord may even be shortened by just threading the draw cord through either the loop and/or the ring to form a double carrying strap.

The towel-bag apparatus may be quickly and easily placed into the closed position by drawing the draw cord and forming a carrying strap by hooking the end of the spring-loaded clip to either the central or peripheral loop.

The invention will be described for the purposes of illustration of only in connection with certain preferred embodiments; however, it is recognized that various changes, modifications, additions and improvements may be made by those persons skilled in the art, all falling within the spirit and scope of the invention.

DESCRIPTION OF THE EMBODIMENTS

Figure 4:
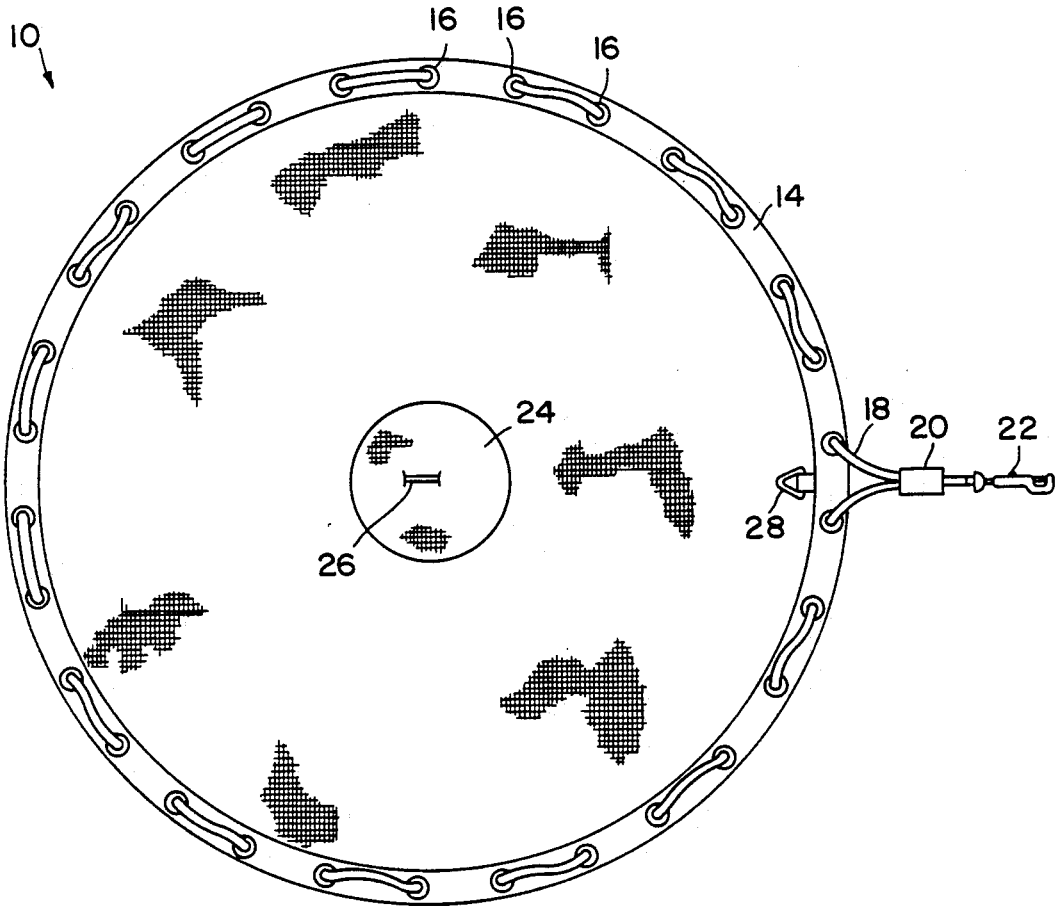
FIG. 4 is a bottom plan view of the towel-bag apparatus of FIG. 2.

The drawings illustrate a towel-bag apparatus 10 of the invention which comprises a generally circular terrycloth towel fabric 12 having a diameter of 4 to 6 feet and a generally reinforced fabric or canvas peripheral 1" to 1½ webbing 14 which includes a plurality of equally spaced apart grommet holes 16, for example, spaced apart 5" to 8", about the periphery and which includes passing through the grommet holes an elastic draw cord 18 having a one and an other end and which is drawn together by a clasp 20 and which includes at the one and other end a spring-loaded hook or clip 22. The bottom surface of the towel element 12 includes secured thereto by an adhesive or sewn on a generally circular, centrally disposed reinforcing section 24 of 6" to 18" in diameter, such as of another or more canvas of different color than the fabric 12. Centrally positioned therein is a cloth loop 26 (diameter 2" to 3"), for example, of nylon. Secured to the reinforced web section 14 and generally adjacent the outlet of the draw cord 18 is another closed metal ring 28, as illustrated in FIG. 4. It is desirable to provide for a soft fabric-type loop 26 rather than a metal loop so as to facilitate use of the generally circular element 12 as a towel.

Figure 1:
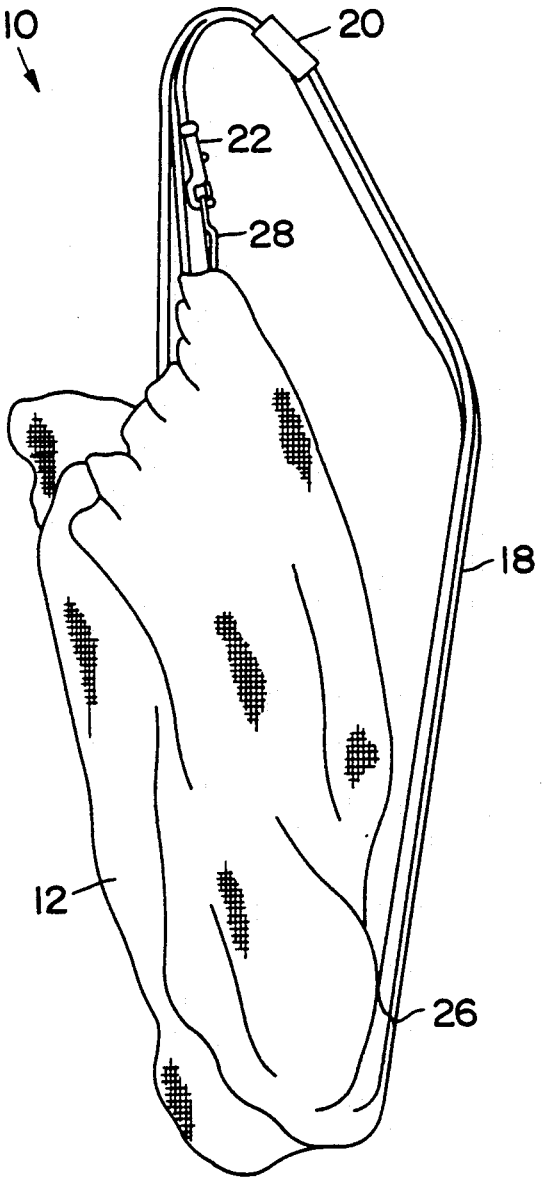
FIG. 1 is a perspective view of the towel-bag apparatus of the invention in a bag-carrying, closed position.
Figure 2:
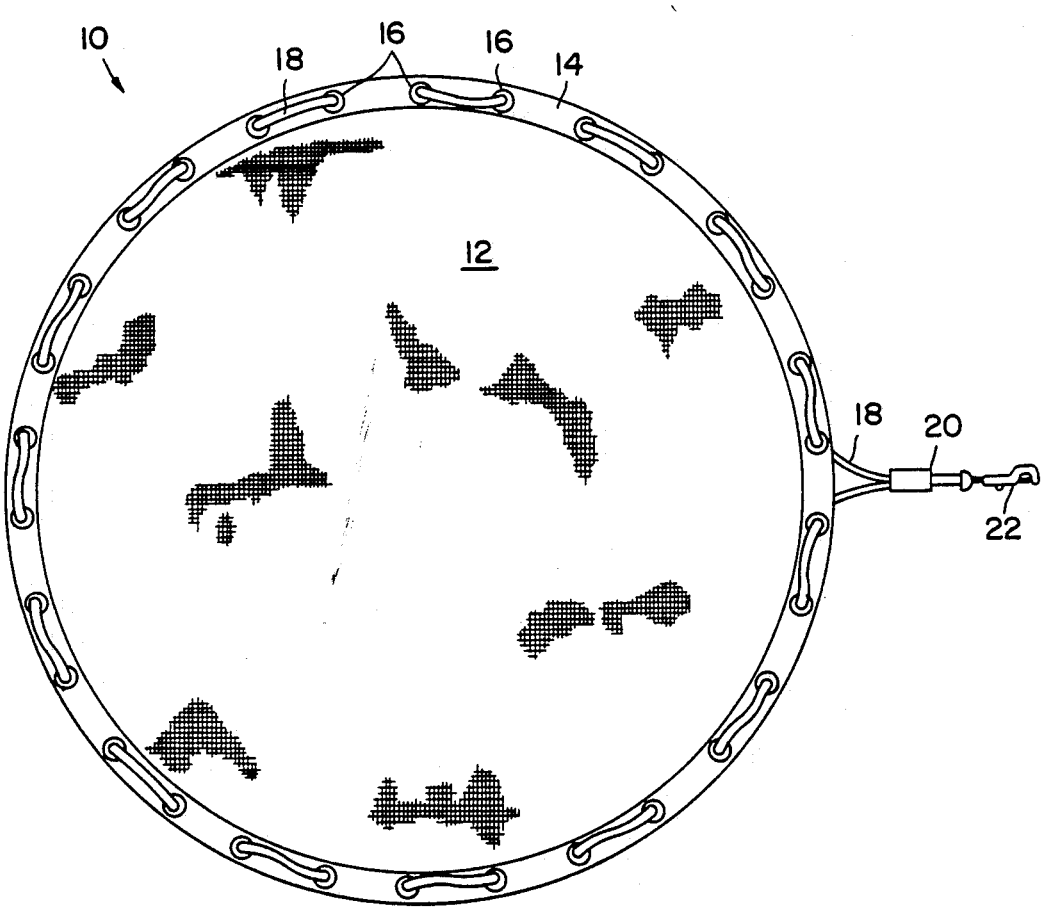
FIG. 2 is top plan view of the towel-bag apparatus of the invention in the open, towel-beach use position.
Figure 3:
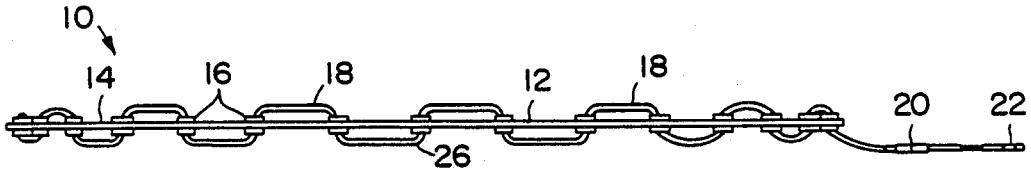
FIG. 3 is a side plan view of the towel-bag apparatus of FIG. 2.

FIG. 1 illustrates the towel-bag apparatus 10 in the bag position, that is, in the closed position, wherein the draw cord 18 has been pulled closed to form a bag-like enclosure with draw cord passed through the loop 26 and upwardly and connecting the ring 28 through the use of the spring loaded clip 22 so as to form a double draw cord 18 for the shoulder carrying of the bag. FIGS. 2–4 illustrate the towel-bag apparatus 10 in the open position wherein the top surface of the towel-bag apparatus may be spread out on the beach or for resting purposes and later for drying purposes as desired with the ring 28 and the soft nylon loop 26 on the bottom surface of the circular towel element so as not to interrupt the function of the towel for resting or towel purposes. The towel-bag apparatus 10 as illustrated thus provides for a use as a beach towel for resting and drying purposes and is readily convertible into an enclosed bag for container purposes with a shoulder carrying strap.

What is claimed is:

1. A towel-bag apparatus which is adapted to move between an open and closed position and which in the open position provides a towel suitable for drying and beach purposes, and in the closed position provides an enclosed bag with a carrying strap, and which towel-bag apparatus comprises in combination:

a) a generally circular, fabric towel element having a reinforced peripheral web and a plurality of holes in the web and having a top surface and a bottom surface, the bottom surface having a generally centrally reinforced section;

b) a loop means generally centrally secured to the the reinforced section;

c) a ring means secured to the reinforced peripheral web; and d) a draw cord means having a one and an other end, the draw cord passing through the holes in the reinforced web of the towel element, so as to permit the circular towel element to move between an open position for towel or beach with the draw cord in a relaxed, extended position use and a closed position for bag use with the draw cord in a drawn position, the draw cord means including a clip-type closure means at the one end and the other end so as to permit the said clip-type enclosure means to engage the loop means or the ring in the closed position to form a carrying strap for the towel-bag apparatus.

2. The towel-bag apparatus of claim 1 wherein the generally circular towel element has a diameter of from four to six feet and wherein the reinforced section is generally circular and has a diameter of from about six to eighteen inches.

3. The towel-bag apparatus of claim 1 wherein the towel element comprises a terrycloth fabric and the central reinforced section is a non-terrycloth fabric.

4. The towel-bag apparatus of claim 1 wherein the loop means comprises a cloth loop means sewn to the reinforced section of the towel element.

5. The towel-bag apparatus of claim 1 wherein the ring means comprises a metal ring means securely fastened to the reinforced web adjacent the one and other end of the draw cord means.

6. The towel-bag apparatus of claim 1 wherein the enclosure means comprises a spring loaded clip at the one and the other end of the draw cord means.

7. A towel-bag apparatus adapted to be placed in an open position which provides a towel suitable for beach or drying purposes and in the closed position provides an enclosed bag with a carrying strap, and which towel-bag apparatus comprises in combination:

a) a generally circular, terrycloth towel element having a diameter of about 4 to 6 feet and having a reinforced peripheral web edge and a plurality of holes in the web and having a top surface and a bottom surface, the bottom surface having a generally circular reinforced section of a non-terrycloth-type material and having a cloth loop centrally secured to the reinforced section and a ring secured to the reinforced peripheral web; and b) an elastic-type draw cord means having a one and the other end and passing through the holes in the web in an alternating fashion so as to permit the circular towel element to move between the open position for towel-beach use and a closed position for bag use, the draw cord means including a spring loaded clip at the one and the other end so as to permit the draw cord means to pass through the loop and the spring loaded clip to engage the ring in the closed position to form a carrying strap for the towel-bag apparatus in the closed position.

* * * * *